US005376145A

United States Patent [19]

Brady et al.

[11] Patent Number: 5,376,145

[45] Date of Patent: Dec. 27, 1994

[54] TREATMENTS TO IMPROVE THE PROPERTIES OF KERATINOUS TEXTILES

[75] Inventors: Peter R. Brady, Highton; Peter G. Cookson, Grovedale; Keith W. Fincher, Drysdale; John R. Cook, Winchelsea, all of Australia

[73] Assignee: Commonwealth Scientific and Industrial Research Organization, Australia

[21] Appl. No.: 466,266

[22] PCT Filed: Aug. 18, 1988

[86] PCT No.: PCT/AU88/00309

§ 371 Date: Apr. 13, 1990

§ 102(e) Date: Apr. 13, 1990

[87] PCT Pub. No.: WO89/01541

PCT Pub. Date: Feb. 23, 1989

[30] Foreign Application Priority Data

Aug. 19, 1987 [AU] Australia ..... PI3824/87

[51] Int. Cl.[5] ..... D06M 13/203; D06M 13/224; D06M 13/402; D06P 3/04

[52] U.S. Cl. ..... 8/128.1; 8/128.3; 8/115.7; 8/404; 8/917; 8/582; 8/583; 8/594; 8/586; 8/587; 8/589; 8/597; 8/598; 8/600; 8/606

[58] Field of Search ..... 8/128.1, 404, 405, 401, 8/115.7, 128.3, 917, 582, 583, 594, 586, 587, 589, 597, 598, 600, 606

[56] References Cited

U.S. PATENT DOCUMENTS 4,017,256 4/1977 Kagel et al. ..... 8/573

FOREIGN PATENT DOCUMENTS 0232934 3/1961 Australia .
0276522 10/1963 Australia .
0103274 3/1984 European Pat. Off. .
54-42477 4/1979 Japan .
55-36343 3/1980 Japan .
5536343 8/1989 Japan .

OTHER PUBLICATIONS

CA 99: 23953.
CA 106: 68681 k.
CA 108: 77067 h.

*Primary Examiner*—Prince Willis, Jr.
*Assistant Examiner*—Alan D. Diamond
*Attorney, Agent, or Firm*—Sughrue, Mion, Zinn, Macpeak & Seas

[57] ABSTRACT

A method of processing a textile material consisting wholly or partly of keratinous fibres, characterised in that the material is treated with an aqueous composition containing at least one compound which possesses one or more ethylenic double bonds activated by two adjacent carbonyl groups. Preferred compounds include fumaric acid or maleic acid, optionally substituted with one or two halo and/or alkyl groups; or a salt, ester or amide of any said acid; or an N-substituted maleimide, optionally substituted with one or two halo and/or alkyl groups.

17 Claims, No Drawings

TREATMENTS TO IMPROVE THE PROPERTIES OF KERATINOUS TEXTILES

This invention is concerned with the treatment of textiles made from keratinous fibres, particularly wool, but including cashmere, mohair, human hair, rabbit hair and the blends of these fibres with synthetic fibres and/or other types of natural fibres. More specifically, the invention is concerned with textile treatment methods aimed at minimizing, or at least reducing, the incidence of one or more of the following faults produced in existing textile processing methods:

1. Loss of bulk of yarn or fabric during dyeing.
2. Increases in hygral expansion of yarns and fabric which result from dyeing.
3. Formation of permanent creases, patterns and deformations in fabric during dyeing, such as running marks which may occur when fabric is dyed in rope form and permanent moire patterns which may occur in fabric during beam dyeing.
4. Damage to keratinous fibres when they are heated above room temperature in water.

However, the invention is not necessarily limited by these objectives and may produce other advantageous effects.

The problem areas listed above and the benefits sought by the methods of the present invention are described in more detail as follows:

1. Loss of Bulk During Dyeing

It is known that as a result of dyeing by conventional methods, at or near 100° C., yarns and fabrics made from keratinous fibres often lose bulk. In other words, after dyeing, the volume occupied by a given weight of dry, fully relaxed yarn or fabric is less than the volume of the fully relaxed, undyed material.

When loss of bulk results from dyeing, the yarn or fabric invariably has been constrained under tension or flattened during the dyeing process and becomes permanently deformed. Examples of dyeing methods in which bulk is lost are:

(i) Package dyeing, in which yarn is wound under tension onto perforated cones or tubes to form cheeses which are dyed by circulating dye liquor radially through the packages.

(ii) Beam dyeing, in which fabric is rolled up under tension onto a perforated beam and then dyed by circulating liquor radially through the rolled-up fabric.

The practical consequences of loss of bulk are undesirable in may cases. Yarns may lose bulk to the extent that they are unsuitable for certain end uses. This particularly applies to many types of hand-knitting yarns, but also is true for some types of machine-knitting yarns. Fabric may be unacceptably flattened or develop moire patterns. In such cases, fabric and yarn must be dyed by methods in which bulk is not lost. However, such methods may incur economic or logistic penalties. For example, crepe hand-knitting yarns are almost invariably dyed in hank form, in order to retain their bulk, even though package dyeing is generally cheaper.

No chemical methods to prevent permanent flattening of fabric as a result of beam dyeing have been reported. The only known chemical method for minimizing the loss of bulk during package dyeing is by addition of oxidizing agents to the dyebath. (J. R. Cook & B. E. Fleischfresser, Proceedings of the Seventh International Wool Textile Research Conference, Vol. V. p 181, (1985). However, this method has not been used commerically because it produces unacceptable changes in the colours of many dyes, because of their susceptibility to oxidation.

One objective of the present invention therefore, is to provide a novel method for preventing such loss of bulk by treatment of the goods with a particular class of compounds, and, in particular compounds which have little or no affect on the colour yields of a wide range of dyes.

2. Hygral Expansion

Hygral expansion of fabric is the increase in linear dimensions which occurs when fabric absorbs water. It is known that the hygral expansion of fabrics made from fibrous keratins is increased when fabric is heated in water at or near the boil for periods ranging from a few minutes up to several hours, such as occurs in conventional dyeing processes. Moderate hygral expansion of fabric has advantages in some types of tailoring because it aids moulding of fabric into three dimensional structures. However, excessive hygral expansion is undesirable because it causes difficulties in sizing garments during making up and is a cause of seam pucker when garments are worn under conditions of varying relative humidity.

A number of treatments have been found which reduce the hygral expansion of fabric. (A. M. Wemyss & M. A. White, Proceedings of the Third Japan-Australia Joint Symposium on Objective Measurement, Kyoto, Japan, p. 165, (September 1985)). These include:

(1) changing the moisture sorption properties of the fibre;

(2) application of polymers;

(3) application of substances which increase the frictional properties of fibres;

(4) introducing extra internal fibre crosslinks;

(5) treatments with oxidizing agents or with certain compounds which react preferentially with thiol groups in keratin.

However, all the known methods suffer from serious disadvantages and not one has gained commercial acceptance. Method (1) requires treatments with large quantities of materials, which apart from being costly, produce undesirable changes in the physical properties of the fibres. Methods (2) and (3) produce adverse changes to the handle of fabric and the procedures required cannot be readily incorporated into dyeing processes. Method (4) necessitates the use of compounds such as formaldehyde, or compounds which release foraldehyde, which are ecologically undesirable. Method (5) involves the use of compounds which produce unacceptable changes in the colour of many dyes.

Thus, another object of the present invention is to provide a method for reducing hygral expansion which does not suffer from any of the disadvantages of previous methods. In particular, the invention aims to provide such a method utilizing compounds which are effective at relatively low levels of application; are easily incorporated into dyeing processes; do not affect the shades of dyes; do not rely on oxidation of the wool and do not contain or liberate formaldehyde.

3. Formation of Running Marks, etc

Running marks, or washer wrinkles, are permanent creases which form (usually in the warp direction) when fabric made from keratinous fibres is dyed or otherwise treated particularly in rope form under wet, hot conditions. Also, permanent creases can be formed in garments when they are dyed or otherwise treated in side-paddle machines and particularly in drum machines. The creases are termed "permanent" because they can not be substantially removed by methods such as blowing, crabbing, decatizing or stentering. In many cases, the creases can be seen in finished fabrics, but sometimes the creases only appear when the fabric becomes wet or is exposed to an atmosphere of high humdity.

The only known methods of inhibiting these creases from forming are:

(1) by bagging (sewing fabric selvages together);

(2) by mechanical design of fabric transport mechanisms to continually re-form the fabric rope as it is conveyed around the machine in which the treatment is being carried out.

(3) by the use of lubricants which prevent the fabric rope from remaining for a long period in a fixed configuration.

These methods are well-known to those skilled in the art of dyeing. Nevertheless, permanent creases are often formed.

Another objective of the present invention, therefore, is to provide a method for chemically inhibiting formation of permanent creases during wet treatments of textile materials in rope form by addition to the treatment bath of compounds which do not interfere with other constituents of the treatment baths, such as dyestuffs, surfactants and dyeing assistants.

4. Fibre Damage

Damage to keratinous fibres as a result of dyeing is measured by tests which reveal (1) weight losses;

(2) decrease in tensile strength of fibres, yarns and fabrics;

(3) decrease in the extension at break of fibres, yarns and fabrics;

(4) decrease in bursting strength of fabrics, particularly when the fabrics are wet;

(5) increase in yellowing.

All these changes are undesirable and are believed to contribute to reductions in processing yields and deteriorated performance of end-products.

In processing of fibre, damage is manifested as (1) decrease in yields and increases in wastage during processes such as carding, combing and spinning and as (2) decrease in processing efficiency, such as increase in end breaks in spinning and weaving and lowered optimal processing speeds.

Previously, damage during dyeing of wool in all its forms has been minimized by adding certain substances to dyebaths. (P. Liechti, Journal of the Society of Dyers and Colourists, 98, 284, (1982). Two types of products are commercially available. One type contains formaldehyde or formaldehyde-donor compounds and the other consists of protective colloids made from proteins, protein hydrolysates or fatty acid-protein condensates. These agents are believed to counteract the hydrolytic degradation of polypeptide chains of wool and prevent extraction of solubilized protein from wool, which would otherwise occur during dyeing. Recently, it has been claimed that addition of certain reactive arylating agents to dyebaths is effective, provided that they (1) crosslink the fibre protein or (2) introduce hydrophobic groups into the fibre structure. (Wool Development International, Patent Application EP 85306256.0 (1985)). In the case of dyeing loose stock, damage has been reduced by the mechanical means of minimizing the pressure drop across the dyeing vessel. (R. L. Holms-Brown & G. A. Carnaby, Journal of the Society of Dyers and Colourists, 98, 162, (1982)).

Thus a further objective of the present invention is to provide a method of minimizing damage to fibre by making use of a novel class of chemical protective agents which exert a protective action on the fibre by a hitherto unknown mechanism.

In contrast to the prior art proposals, the protective agents contemplated for use in the present invention are not essentially crosslinking agents, since they may contain only one reactive moiety. Also, the compounds do not necessarily introduce hydrophobic groups into wool, rather hydrophilic groups are introduced in some cases. Further, the compounds do not form colloidal solutions.

In accordance with the broadest aspect of this invention, there is provided a method of simultaneously or separately achieving the aforementioned objectives by treating keratinous materials in aqueous solution with a compound, or mixture of compounds, possessing one or more ethylenic double bonds activated by two adjacent carbonyl groups.

Preferably, the compounds used in accordance with this invention belong to one of the classes of compounds set out below.

1. Compounds of the formula $$M_1O.O{=}C\text{-}CX{=}CY\text{-}C{=}O.OM_2$$

where X and Y are the same or different and each is a hydrogen atom, or a halogen atom, preferably chlorine, or an alkyl group containing from 1 to 12 carbon atoms, preferably a methyl or octyl group; $M_1$ and $M_2$ are the same or different and each is (1) hydrogen; (2) an alkali, alkaline earth or transition metal preferably sodium, potassium, magnesium, calcium, barium, zinc, chromium, cobalt, nickel or manganese; or (3) an ammonium ion, or a substituted ammonium ion of the formula $R_1R_2R_3R_4N^+$, where $R_1$, $R_2$, $R_3$, $R_4$ are the same or different and each is hydrogen or an alkyl or aryl group containing 1 to 18 carbon atoms, and where any two or more of the groups $R_1$, $R_2$, $R_3$, $R_4$ may form part of a heterocyclic ring. Preferably the alkyl group contains 1 to 4 carbon atoms.

Examples of substituted ammonium ions are ethylammonium, trimethyl ammonium, pyridinium, N-ethyl pyridinium, benzyl trimethylammonium and cetylpyridinium ions.

Particularly preferred compounds are fumaric acid and especially maleic acid and their sodium and ammonium half- and double-salts.

2. Compounds of the formulae $$M_1O.O{=}C\text{-}CY{=}CY\text{-}C{=}O.OR_5, \text{ or}$$

$$R_5O.O{=}C\text{-}CX{=}CY\text{-}C{=}O.OR_6, \text{ or}$$

$$M_1O.O{=}C\text{-}CX{=}CY\text{-}C{=}O.OR_7O.O{=}C\text{-}CX{=}CY\text{-}C{=}O.OM_2,$$

where X, Y, $M_1$ and $M_2$ are as defined above;

$R_5$ and $R_6$ are the same or different and each is a (1) substituted or unsubstituted alkyl or aryl group containing up to 18 carbon atoms (preferably methyl, ethyl, n-butyl, 2-butyl, iso-butyl, n-hexyl, cyclohexyl, phenyl, p-sulphophenyl, p-nitrophenyl, benzyl, 2-ethylhexyl, n-octyl, decyl, lauryl, oleyl, or stearyl); or (2) a polyalkoxy ether of the formula $R_8O(R_9O)_n$—, where $R_8$ is a hydrogen atom or an alkyl group containing from 1 to 4 carbon atoms, $R_9$ is an ethylene, propylene or butylene group (preferably an ethylene or propylene group) and n is a number from 1 to 6 (preferably 2); $R_7$ is (1) a straight or branched chain aliphatic group containing from 1 to 12 carbon atoms and preferably 2 to 10 carbon atoms, preferably an ethylene, butylene, hexylene, decylene or —$CH(CH_3)$—$CH(CH_3)$—$CH(CH_3)$— group; or (2) an arylene group, such as a phenylene or substituted phenylene group.

The esters and related ammonium and sodium salts derived from fumaric acid and especially maleic acid are particularly preferred. 3. Compounds of the formulae $$R_{10}R_{11}N.O{=}C\text{-}CX{=}CY\text{-}C{=}O.NR_{10}R_{11}, \text{ or}$$

$$M_1O.O{=}C\text{-}CX{=}CY\text{-}C{=}O.N(R_{10}).R_7.N(R_{11}.O{=}C\text{-}CX{=}CY\text{-}C{=}O.M_2,$$

or $$M_1O.O{=}C\text{-}CX{=}CY\text{-}C{=}O.N(CH_2CH_2)_2N.O{=}C\text{-}CX{=}CY\text{-}C{=}O.M_2, \text{ or}$$

$$M_1O.O{=}C\text{-}CX{=}CY\text{-}C{=}O.NR_{10}R_{11});$$

where X, Y, $M_1$, $M_2$, and $R_7$ are as defined above; $R_{10}$ and $R_{11}$ are the same or different and each is hydrogen or an alkyl group containing up to 18 carbon atoms (preferably methyl, ethyl, n-butyl, 2-butyl, iso-butyl, n-hexyl, cyclohexyl, phenyl, p-sulphophenyl, p-nitrophenyl, benzyl, 2-ethylhexyl, n-octyl, di-isobutyl, decyl, lauryl, oleyl, or stearyl).

The amides derived from fumaric acid, and their sodium salts, and especially the amides derived from maleic acid, and their sodium salts, are particularly preferred.

4. Compounds of the formula $$M_1O.O{=}C\text{-}CX{=}CY\text{-}C{=}O.N(R_{10})R_7O.O{=}C\text{-}CX{=}CY\text{-}C{=}O.M_2,$$

where X,Y, $M_1$, $M_2$, $R_7$ and $R_{10}$ are as defined above.

5. Compounds of the formulae

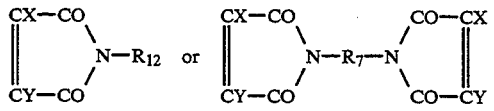

where $R_{12}$ is (1) a hydrogen atom; (2) a substituted or unsubstituted alkyl or aryl group containing up to 18 carbon atoms, preferably a methyl, ethyl or p-sulphophenyl group; or (3) a —$CO.NH_2$ group; and X, Y and $R_7$ are as defined above.

Treatment with the above described compounds, to achieve any of the objectives specified previously, may be carried out at any stage during processing of fibre into end-products, but preferably prior to, or as part of, a dyeing process. In particular, the compounds may be added directly to dyeing liquors or dyebaths, without substantial changes to existing dyeing methods. The compounds may be dissolved or dispersed in treatment baths or dye liquors, together with substances to buffer pH, salts, auxiliary products and dyes when appropriate. Treatments may be carried out at any temperature between 0° and 150° C., for times ranging from one minute to 48 hours.

In the case of long-liquor dyeing treatments, fibre may be immersed in treatment baths, as described above, at liquor-to-goods ratios which may vary from 5:1 to 500:1 and then the baths may be heated at rates varying from 0.5° to 5° C. per minute to final temperatures which may vary from 75° to 150° C., and heating at the maximum temperature may be continued for up to 600 minutes.

With treatments carried out a liquor-to-goods ratio between 0.5:1 and 5:1, the treatment liquor may be applied by padding, dipping, or spraying. The treated material may be kept at temperatures between 0° and 150° C. for periods of from 1 minute up to 48 hours.

Application levels of suitable compounds vary from 0.1% to 20% by weight of the keratinous material to be treated, but the levels are preferably in the range of 1% to 10%.

The following examples are provided to illustrate the invention but should not be construed as limiting it in any way.

Registered Trade Marks used herein are acknowledged at the end of this description.

EXAMPLE 1

In this example, it is demonstrated that decreases in the bulk of hand knitting yarn can be minimized when wool yarn is package dyed in the presence of sodium hydrogen maleate.

Pure wool R447 tex 3/3 crepe hand knitting yarn was wound at a density of 350 grams per liter onto Davidson spring centres and dyed in a package dyeing machine with axial compression of the packages of 10%. The dye liquor was circulated from inside to outside of the packages. The dye liquor contained 2 g/l sodium acetate, 3% (o.w.f.) acetic acid, 10% (o.w.f.) sodium sulphate, 1% (o.w.f.) ALBEGAL SET (Ciba-Geigy) and 5% (o.w.f.) sodium hydrogen maleate. The pH of the dyebath was approximately 4.5. After circulation of the liquor at 50° C. for 15 minutes, 1% (o.w.f.) LANASET Green B (Ciba-Geigy), was added and the temperature was increased at 1° C. per minute to 100° C. and was maintained at 100° C. for 30 minutes.

After rinsing with water in the dyeing machine, the packages were centrifuged in a Frauchinger single package hydroextractor and dried in a Strayfield radio-frequency drier. The packages were then unwound and formed into hanks which were relaxed by steaming whilst laid flat and free of tension.

The bulk of the yarn was measured with a WRONZ Bulkometer, according to the method described by the manufacturer. The bulk of the yarn was found to be 10.1 cubic centimeters per gram and this compared favorably with 10.3 cubic centimeters per gram for the undyed yarn and was much greater than the value of 8.0 cubic centimeters per gram for yarn dyed and processed by the same procedure but without the addition of sodium hydrogen maleate to the dyebath.

EXAMPLE 2

In this example, a different yarn was processed by the method described in Example 1. The bulk of this yarn was also substantially retained after dyeing.

The procedure of Example 1 was followed using a pure wool hand knitting yarn of R347 tex 3/2 yarn, which had been Kroy chlorinated with 0.8% active chlorine.

The bulk of the yarn, measured by the method used in Example 1, after dyeing in a bath to which sodium hydrogen maleate had been added was 8.2 cubic centimeters per gram, compared with 8.8 cubic centimeters per gram for the undyed yarn and 6.9 cubic centimeters per gram for yarn dyed by the same procedure but without the addition of the solution of sodium hydrogen maleate to the dyebath.

EXAMPLE 3

This is another example in which the bulk of dyed hand knitting yarn was retained by the use of different processing conditions to those used in Examples 1 and 2, particularly as far as relaxation of the yarn after dyeing is concerned.

240 kg of the R477 tex 3/3 pure wool yarn used in Example 1 was wound onto non-woven polypropylene sleeves to make cheeses of 2.4 kg. These were dyed in a package dyeing machine and dye liquor was circulated only from inside to outside of the packages. The dyebath was set with 1.5% (o.w.f.) ALBEGAL FFD (Ciba-Geigy), 1.0% (o.w.f.) ALBEGAL SET (Ciba-Geigy), 10% (o.w.f.) sodium sulphate 3% (o.w.f.) acetic acid and 5% (o.w.f.) sodium hydrogen maleate. The pH of the dyebath was then adjusted to 4.5 with acetic acid and the dye liquor was circulated for 20 minutes. Then 0.12% (o.w.f.) SUPRANOL Red 3BL (Bayer) C.I. Acid Red 158, 0.18% (o.w.f.) LANSET Yellow 4G (Ciba-Geigy) were added. The temperature was raised from 25° C. at 1° C. per minute to 80° C. and then at 0.5° C. per minute to 103° C. and held for 30 minutes at that temperature. After cooling to 75° C., the wool was rinsed once with water at that temperature, then rinsed once more with water at 25° C. and then treated at that temperature for 15 minutes with a solution containing 0.2% SERISOFT ZAS (Yorkshire Chemicals) and 0.5% acetic acid.

The packages were then hydroextracted in a centrifuge and the yarn was dried using a Hirschberger yarn relaxing and drying machine, in which the yarn was unwound and dried under tension-free conditions, before being coiled up on circular pallets.

The bulk of this yarn was 10.0 cubic centimeters per gram compared with 8.0 cubic centimeters per gram when dyed without the addition of sodium hydrogen maleate to the dyebath (but otherwise processed in an identical manner). Subjective assessment of the yarn dyed in the presence of the maleate salt indicated that its bulk was midway between that of hank dyed yarn and yarn made from dyed top. This yarn was judged to be commercially acceptable as an alternative to yarn dyed in hank form.

EXAMPLE 4

In this example, the presence of sodium hydrogen maleate in the dyebath is shown to have little effect on the shades obtained with a number of dyes.

The method and materials described in Example 1 were used to obtain samples of yarn dyed in the presence and absence of 5% (o.w.f.) sodium hydrogen maleate in the dyebath. Lengths of yarn were wound onto cards and the colour differences between dyeings were measured using a Gardiner Spectrogard reflectance spectrophotometer. Colour Differences between Fabric Samples Dyed With and Without 5% Sodium Hydrogen Maleate in the Dyebath

| Dye | Colour Difference (NBS Units) |
|---|---|
| LANASET Yellow 4G | 0.58 |
| LANASET Orange R | 0.08 |
| LANASET Red 2B | 0.60 |
| LANASET Red G | 0.91 |
| LANASET Bordeaux B | 0.37 |
| LANASET Violet B | 0.49 |
| LANASET Blue 5G | 0.77 |
| LANASET Blue 2R | 0.55 |
| LANASET Navy R | 0.80 |
| LANASET Green B | 0.44 |
| LANASET Brown B | 0.64 |
| LANASET Brown G | 0.79 |
| LANASET Grey G | 0.19 |
| LANASET Black B | 0.49 |
| SANDOLAN Golden Yellow MF-RL | 0.65 |
| SANDOLAN Red MF-GRL | 0.96 |
| SANDOLAN Blue MF-GL | 0.99 |
| SANDOLAN Green MF-BL | 0.39 |

Since NBS colour differences of less than one unit are generally accepted to be within the limits of commercial acceptability, none of the dyes were significantly affected by the presence of sodium hydrogen maleate.

EXAMPLE 5

In this example, the ability of a range of compounds to prevent the setting of permanent creases in wool fabric during dyeing is demonstrated.

The propensity of fabrics to form permanent creases during dyeing can be assessed by a simple test. Pleats are sewn into fabrics and after the treatment in which set is likely to be imparted, yarns which were bent through 180 degrees are removed from the creased fabric and relaxed in water at 70° C. for 30 minutes. The degree of permanent set in the fabric crease is calculated as a percentage of the angle ($\theta$) of the crease remaining in the yarn as $100\times(180-\theta)/180$.

Pleats were sewn into lengths of 146 gram per square meter plain weave, pure wool merino fabric which were then dyed as follows. The wool was wet out and equilibrated at 50° C. at a liquor-to-wool ratio of 20:1 in an aqueous bath in a winch which contained 1 g/l ALBEGAL FFA (Ciba-Geigy), 10% (o.w.f.) sodium acetate, 1% (o.w.f.) ALBEGAL SET (Ciba-Geigy) and quantities of the special treating agents as set out below. All percentages of these compounds were calculated on the weight of wool. The pH of each bath was adjusted to 4.5 by the addition of acetic acid. After running for 15 minutes, 0.5% (o.w.f.) LANSET Brown B (Ciba-Geigy) was added and the temperature of the bath raised at 1° C. per minute to 100° C. and held at that temperature for 60 minutes. The bath was then cooled at 1° C. per minute to 70° C. and the fabric was then unloaded. Samples of yarn were taken from the pleats and tested as described above to determine the levels of set imparted to the fabrics.

| Treatment | % Set |
|---|---|
| None | 75 |
| 2% sodium hydrogen maleate | 51 |
| 5% sodium hydrogen maleate | 35 |
| 5% sodium ethyl maleate | 31 |
| 5% sodium 2-ethylhexyl maleate | 24 |
| 3% sodium hydrogen fumarate | 51 |
| 2% ammonium p-nitrophenyl maleate | 21 |

-continued

| Treatment | % Set |
|---|---|
| 5% di-ammonium hexylene-1,6-dimaleate | 29 |
| 5% sodium hydrogen 2-chloromaleate | 21 |
| 5% sodium hydrogen 2-methylmaleate | 57 |
| 5% disodium p-phenylenediamine dimaleate | 27 |

All the fabrics showed a reduced tendency to form creases when dyed in the presence of the treating agents.

Example 6

In this example, increases in hygral expansion of fabric which would otherwise occur as a result of dyeing treatments, are shown to be reduced when ammonium hydrogen maleate and ammonium ethyl maleate are added to dyebaths.

In preparation for dyeing, a 2/2 twill pure wool fabric of 252 grams per square meter, woven from 2/40 metric yarn at 26.4 ends per centimeter and 22.0 picks per centimeter, was Dolly scoured at 50° C. with 1 g/l Diadavin EWN (Bayer) and rinsed and dried.

Three pieces of this fabric were subjected to dyeing treatments in an Ahiba Turbomat laboratory dyeing machine at a liquor-to-wool ratio of 20:1 but without the addition of dye. The dyebath was set at 40° C. with 1% (o.w.f.) ALBEGAL B (Ciba-Geigy) and 4% (o.w.f.) ammonium sulphate. The pH of the bath was adjusted to 4.5 by the addition of acetic acid and the liquor was circulated for 20 minutes. In the first experiment of this series, no further additions were made to the dyebath. In the second experiment, 5% (o.w.f.) maleic anhydride was dissolved in water which contained an equimolar amount of ammonia (3.1% o.w.f. of 28% solution) to produce the half ammonium salt of maleic acid. The pH of the solution was adjusted to 4.5 and the solution was added to the dyebath. In the third experiment, 5% (o.w.f.) of maleic anhydride was dissolved in an equimolar quantity of ethyl alcohol (2.3% o.w.f.) to form the monoethyl ester of maleic acid. The ester was then dissolved in an aqueous solution containing an equimolar amount of ammonia (3.1% o.w.f. of 28% solution) to form the ammonium ethyl maleate salt. The pH of the solution was adjusted to 4.5 and the solution was added to the dyebath. In each case, the temperature of the dyebath was then raised at 1.5° C. per minute to 98° C. and held for two hours. The baths were then cooled at 1.5° C. per minute to 70° C. and the fabric samples removed, rinsed and dried.

The hygral expansion (expressed as the percentage increase in length in the warp direction which occurred when the completely dry fabric was wet out in water) measured on the untreated fabric was 3.4%. The hygral expansion increased to 7.1% when the fabric was blank dyed in the absence of any special reagent. However, in the presence of ammonium hydrogen maleate, the hygral expansion was only 4.5% and in the present of ammonium ethyl maleate it was only 4.3%.

EXAMPLE 7

In this example, commercial piece dyeings have been used to show the benefits of adding ammonium ethyl maleate to a dyebath in order to decrease changes in hygral expansion, wet bursting strength, tear strength and abrasion resistance of fabric.

Two lengths of 2/2 twill pure wool fabric, woven from 2/53's worsted count yarn, with 34.6 ends and 20.5 picks per centimetre, were prepared for dyeing by decatizing and scouring as described in Example 6.

The fabrics were dyed at a liquor-to-wool ratio of 20:1 in a shallow draft winch. The dyebaths were set at 50° C. with 10% (o.w.f.) sodium sulphate, 1.0% (o.w.f.) LYOGEN MF (Sandoz) and sufficient acetic acid to bring the pH of the dyebath to 4.5. To one dyebath was added 5% (o.w.f.) of ammonium ethyl maleate (AEM). After running for 15 minutes, during which time the pH of each bath was checked and adjusted to 4.5 as necessary, 4.8% SANDOLAN Blue MF-BLN (Sandoz), 0.4% Sandolan Golden Yellow MF-RL and 0.9% Sandolan Red MF-2BL were added. The temperature of each dyebath was then raised at 1° C. per minute to 98° C. and held for one hour. The fabrics were cooled at 1° C. per minute to 60° C. and then rinsed, dried and blown. The following results of physical measurements were obtained.

| Test | Undyed | Dyed Without AEM | Dyed With AEM |
|---|---|---|---|
| Hygral Expansion, Warp (%) | 3.3 | 7.3 | 4.7 |
| Wet Bursting Strength (kpa) | 455 | 421 | 448 |
| Abrasion Resistance (rubs) | 41000 | 24500 | 32000 |
| Tear Strength - Warp (N) | 22.6 | 17.8 | 20.5 |

The test methods used were as follows. For wet bursting strength, fabric was padded with water to give 70% pickup and then tested according to "Methods of Test for Textiles"B.S. Handbook No 1 (1963) p. 260 (Mullen Instrument). For abrasion resistance, the Martindale method, Australian Wool Corporation TM 112, was used. For hygral expansion, the method described in Example 6 was used. For tear strength, the Elmendorf method, ASTM D1424-83 was used.

The results show clearly that the AEM had a protective effect on the wool during dyeing. Only small increases in hygral expansion were observed and losses in wet bursting strength, abrasion resistance and tear strength were significantly reduced. In addition, visual inspection of the fabrics showed that running marks were much less obvious in the fabric dyed in the presence of AEM.

EXAMPLE 8.

In this example, the presence of sodium hydrogen meleate in treatment baths is shown to have a protective effect on physical properties of wool fabric at both 100° C. and 120° C. Dye was not added in these experiments. Pieces of plain-weave fabric of 146 grams per square meter were treated at a liquor-to-wool ratio of 20:1 in an Ahiba Turbomat Laboratory dyeing machine. The baths were set at 50° C. with 10% (o.w.f.) sodium sulphate, 1% (o.w.f.) ALBEGAL SET (Ciba-Geigy) and 2g/l sodium acetate. In two cases, 5% (o.w.f.) of sodium hydrogen maleate (SHM) was added to the bath. In each case the pH of the bath was adjusted to 4.5 by addition of acetic acid. After 15 minutes, the temperature of each bath was raised at 1° C. per minute to either 100° C. or 120° C., as required, and held for 60 minutes. The samples were then cooled at 1° C. per minute to 70° C., rinsed and dried. The following test results were obtained.

| Test | Unt. | Max. Dyeing Temp. 100° C. No SHM | 100° C. 5% SHM | 120° C. No SHM | 120° C. 5% SHM |
|---|---|---|---|---|---|
| Wet Bursting Strength (kpa) | 270 | 246 | 264 | 144 | 188 |
| Breaking Load (N) | 285 | 275 | 281 | 230 | 247 |
| Extension at Break (%) | 31.4 | 36.2 | 38.1 | 16.8 | 25.9 |
| Tear Strength | | | | | |
| - Wrap (N) | 19.2 | 17.9 | 18.8 | 12.3 | 15.4 |
| - Weft (N) | 13.6 | 12.3 | 13.1 | 9.0 | 11.6 |
| Yellowness Index | 26.2 | 28.2 | 28.0 | 38.3 | 37.7 |

The test methods used were the same as in Example 7 with the addition of breading load and extension at break by the grab test method ASTM D1682-64. The yellowness index was taken as 100(Z-X)/Y, where X,Y and Z were the tristimulus values measured with a Gardiner Spectrogard Reflectance Spectrophotometer.

These results show that in every test, both at 100° C. and 120° C., the physical properties of fabric were impaired to a lesser extent during the treatment, as a result of the protective action of the sodium hydrogen maleate in the bath.

EXAMPLE 9.

In this example, the bulk of two types of hand knitting yarns is shown to be largely retained by the addition of ammonium 2-ethylhexyl maleate at pH 6.

Packages to the two yarns used in Examples 1 and 2 were dyed, at a liquor-to-wool ratio of 15:1, as follows. Each dyebath was set at 50° C. with 3% (o.w.f.) ammonium sulphate, 1.0% (o.w.f.) LYOGEN MS (Sandoz) and sufficient acetic acid to bring the pH of the dyebath to 6.0. A solution of 5% (o.w.f.) ammonium 2-ethylhexyl maleate was added to one of the dyebaths. After running for 15 minutes, during which time the pH of each bath was checked and adjusted to 6.0 as necessary, 1.0% LANASYN Brown GRL (Sandoz) C.I. Acid Brown 369 was added. The temperature of each dyebath was then raised at 1° C. per minute to 98° C. and held for one hour. The dyebaths were cooled at 1° C. per minute to 60° C. The packages were rinsed twice with warm water and then treated in a bath at 50° C. containing 1% Sapamine WL (Ciba-Geigy) and which had been adjusted to pH 4.3 with acetic acid. The packages were dried and the yarn relaxed by steaming, as in Example 1.

The bulk of the R447 tex yarn used in Example 1, measured by the method used in Example 1, after dyeing in a bath to which ammonium 2-ethylhexylmaleate had been added was 10.0 cubic centimeters per gram, compared with 10.3 cubic centimeters per gram for the undyed yarn and 8.6 cubic centimeters per gram for yarn dyed without the addition of ammonium 2-ethylhexylmaleate to the dyebath.

The bulk of the R347 tex yarn used in Example 2, measured by the method used in Example 1, after dyeing in a bath to which ammonium 2-ethylhexylmaleate had been added was 8.0 cubic centimeters per gram, compared with 8.8 cubic centimeters per gram for the undyed yarn and 7.3 cubic centimeters per gram for yarn dyed by the same procedure but without the addition of the solution of ammonium 2-ethylhexylmaleate to the dyebath.

EXAMPLE 10.

In this example, the increase in hygral expansion of a fabric is shown to be greatly reduced when the ammonium salts of either of two maleic acid diol-esters were present in blank dyebaths at pH 6. Dye was not added to the dyebaths in these experiments.

2/2 twill pure wool fabric, woven from 2/53' worsted count yarn, with 34.6 ends and 20.5 picks per centimeter, was prepared for dyeing by decatizing and scouring as described in Example 6.

The fabric was blank-dyed at a liquor-to-wool ratio of 20:1 in a laboratory dyeing machine. The dyebath was set at 40° C. with 10% (o.w.f.) sodium sulphate, 1.5% (o.w.f.) LYOGEN MF (Sandoz) and sufficient acetic acid to bring the pH of the dyebath to 6.0. After running for 25 minutes, during which time the pH of each bath was checked and adjusted to 6.0 as necessary, 5% (o.w.f.) of the diammonium salt of the ester prepared by reacting maleic anhydride with half the molar amount of hexane-1,6-diol (DAHDDM) was added. The pH of the bath was readjusted to 6.0 and the liquor circulated for 20 minutes. The temperature of the dyebath was then raised at 1.5° C. per minute to 100° C. and held for two hours. The fabric was cooled at 1.5° C. per minute to 60° C. and then rinsed with cold water and dried.

The hygral expansion of the fabric was measured by the method described in Example 6. The value for the untreated fabric warp was 3.6%. The hygral expansion increased to 8.0% when the fabric was blank-dyed in the absence of any special reagents. However, in the presence of DAHDDM the hygral expansion was only 5.5%. When DAHDDM was replaced in the above procedure by the diammonium salt of the ester formed by reacting decane-1,10-diol with maleic anhydride in a molar ratio of 1:2, the hygral expansion of the fabric was only 4.6%.

EXAMPLE 11

In this example, sodium cyclohexyl maleate is used to restrict the increase in hygral expansion which occurs as a result of piece dyeing.

Two lengths of 2/2 twill pure wool fabric, woven from 2/53's worsted count yarn, with 34.6 ends and 20.5 picks per centimeter, were prepared for dyeing by decatizing followed by scouring at 50° C. with 1 g/l DIADAVIN EWN (Bayer) and rinsed and dried.

The fabrics were dyed at a liquor-to-wool ratio of 20:1 in a shallow-draft winch. The dyebaths were set at 50° C. with 10% (o.w.f.) sodium sulphate, 1.0% (o.w.f.) LYOGEN MF (Sandoz) and sufficient acetic acid to bring the pH of the dyebath to 4.5. To one dyebath was added 3% (o.w.f.) of sodium cyclohexyl maleate. After running for 15 minutes, during which time the pH of each bath was checked and adjusted to 4.5 as necessary, 4.8% SANDOLAN Blue MF-BLN (Sandoz), 0.4% SANDOLAN Golden Yellow MF-RL and 0.9% SANDOLAN Red MF-2BL were added. The temperature of each dyebath was then raised at 1° C. per minute to 98° C. and held for one hour. The fabrics were cooled at 1° C. per minute to 60° C. and then rinsed, dried and blown.

The hygral expansion of undyed fabric was 3.8%. After dyeing in the absence of sodium cyclohexyl maleate, hygral expansion increased to 7.7%, but when the fabric was dyed in the presence of sodium cyclohexyl maleate, the hygral expansion increased to only 4.6%. Generally, it is desirable to restrict the hygral expansion of fabrics to values of less than 6% if they are to be tailored into structured garments.

EXAMPLE 12

In this example, ammonium benzyl maleate is used to preserve the bulk of package dyed hand knitting yarn under industrial conditions.

240 kg of an R477 tex 3/3 pure wool yarn was wound onto non-woven polypropylene sleeves to make cheeses of 2.4 kg with a density of 0.33 g/cc. These were dyed with 20% axial compression in a package dyeing machine at a liquor-to-wool ratio of 7:1. Dye liquor was circulated only from inside to outside of the packages and the pressure drop across the packages was 0.65 bar. The dyebath was set with 1.5% (o.w.f.). ALBEGAL FFD (Ciba-Geigy), 1.0% (o.w.f.) Avolan UL75 (Bayer), 10% (o.w.f.) sodium sulphate, 2% (o.w.f.) sodium acetate, 3.5% (o.w.f.) acetic acid and 3% (o.w.f.) ammonium benzyl maleate. The pH of the dyebath was 4.5. The dye liquor was circulated for 20 minutes, then 1.15% (o.w.f.) of SUPRANOL Blue RLW (Bayer) C.I. Acid Blue 204 was added. The temperature was raised from 25 degrees Celsius at 1° C. per minute to 80° C. and then at 0.5° C. per minute to 100° C. and held for 30 minutes at that temperature. After cooling to 75° C., the wool was rinsed twice with water at 25° C. and then treated at that temperature for 15 minutes with a solution containing 0.5% SERISOFT ZAS (Yorkshire Chemicals) and 0.5% acetic acid (90%). The packages were then centrifuged. Yarn was then unwound and dried in a Hirschberger dryer under fully relaxed conditions. A control dyeing was carried out identically to the above method except that the ammonium benzyl maleate was omitted from the dyebath.

Bulk of the yarn was measured as in Example 1. The bulk of the yarn dyed in the presence of ammonium benzyl maleate was 10.0 cc/g and in the absence of the maleate salt was 8.2 cc/g. Commerical hank dyed yarn of this type was found to have a bulk of 9.0 cc/g. Therefore, it is evident that the use of the maleate salt enabled yarn with acceptable bulk to be produced by a package dyeing route, whereas in the absence of the sodium benzyl maleate the bulk of package dyed yarn is inferior to that of conventionally produced yarn.

The following Registered Trade Marks are used herein: ALBEGAL, DIADAVIN, LANASET, LANASYN, LYOGEN, SANDOLAN, SERISOFT, SUPRANOL.

I claim:

1. A method of processing a textile material consisting wholly or partly of keratinous fibres to reduce the harmful effects of dyeing said keratinous fibers, characterized in that the material is contacted with an aqueous composition consisting essentially of at least one compound selected from the group consisting of a salt, ester and amide of maleic acid or fumaric acid, said salt, ester or amide having one of the following formulae:

a) $M_1O.O{=}C{-}CX{=}CY{-}C{=}O.OR_5$;

b) $M_1O.O{=}C{-}CX{=}CY{-}C{=}O.OR_7O.O{=}C{-}CX{=}CY{-}C{=}O.OM_2$;

c) $R_{10}R_{11}N.O{=}C{-}CX{=}CY{-}C{=}O.NR_{10}R_{11}$;

d) $M_1O.O{=}C{-}CX{=}CY{-}C{=}O.N(R_{10}).R_7N(R_{11}).O{=}C{-}CX{=}CY{-}C{=}O.OM_2$;

e) $M_1O.O{=}C{-}CX{=}CY{-}C{=}O.N(CH_2CH_2)_2N.O{=}C{-}CX{=}CY{-}C{=}O.OM_2$;

f) $M_1O.O{=}C{-}CX{=}CY{-}C{=}O.NR_{10}R_{11}$; or g) $M_1O.O{=}C{-}CX{=}CY{-}C{=}O.N(R_{10})R_7O.O{=}C{-}CX{=}CY{-}C{=}O.OM_2$ where X and Y are the same or different and each is a hydrogen atom, a halogen atom or an alkyl group containing from 1 to 12 carbon atoms;

$M_1$ and $M_2$ are the same or different and each is (1) hydrogen; (2) an alkali, alkaline earth or transition metal; or (3) an ammonium ion, or a substituted ammonium ion of the formula $R_1R_2R_3R_4N^+$, where $R_1$, $R_2$, $R_3$, $R_4$ are the same or different and each is hydrogen or an alkyl group having from 1 to 18 carbon atoms or aryl group having from 6 to 18 carbon atoms, or where any two or more of the groups $R_1$, $R_2$, $R_3$, $R_4$, form part of a heterocyclic ring;

$R_5$ is selected from the group consisting of methyl, ethyl, n-butyl, 2-butyl, iso-butyl, n-hexyl, cyclohexyl, phenyl, p-sulphophenyl, p-nitrophenyl, benzyl, 2-ethylhexyl, n-octyl, decyl, lauryl, oleyl, and stearyl;

$R_7$ is (1) a straight or branched chain aliphatic group containing from 1 to 12 carbon atoms; or (2) an arylene group; and $R_{10}$ and $R_{11}$ are the same or different and each is hydrogen, an alkyl group containing up to 18 carbon atoms, phenyl, p-sulphophenyl, p-nitrophenyl, benzyl, or oleyl, wherein said material is contacted with said aqueous composition simultaneous with or prior to dyeing of said keratinous fibers.

2. A method as claimed in claim 1 wherein the compound has the formula $M_1O.O{=}C{-}CX{=}CY{-}C{=}O.OR_5$; or $M_1O.O{=}C{-}CX{=}CY{-}C{=}O.OR_7O.O{=}C{-}CX{=}CY{-}C{=}O.OM_2$;

where X, Y, $M_1$, $M_2$, $R_5$ and $R_7$ are as defined in claim 1.

3. A method as claimed in claim 2 wherein $R_7$ is an ethylene, butylene, hexylene, decylene or $-CH(CH_3)-CH(CH_3)-CH(CH_3)-$ group or said arylene group where said arylene group is phenylene.

4. A method as claimed in claim 1, wherein the compound has one of the following formulae c) $R_{10}R_{11}N.O{=}C{-}CX{=}CY{-}C{=}O.NR_{10}R_{11}$;

d) $M_1O.O{=}C{-}CX{=}CY{-}C{=}O.N(R_{10}).R_7N(R_{11}).O{=}C{-}CX{=}CY{-}C{=}O.OM_2$;

e) $M_1O.O{=}C{-}CX{=}CY{-}C{=}O.N(CH_2CH_2)_2N.O{=}C{-}CX{=}CY{-}C{=}O.OM_2$; or f) $M_1O.O{=}C{-}CX{=}CY{-}C{=}O.NR_{10}R_{11}$ wherein X, Y, $M_1$, $M_2$, $R_7$, $R_{10}$ and $R_{11}$ are as defined in claim 16.

5. A method as claimed in claim 4, wherein $R_{10}$ and $R_{11}$ are independently methyl, ethyl, n-butyl, 2-butyl iso-butyl, n-hexyl, cyclohexyl, phenyl, p-sulphophenyl, p-nitrophenyl, benzyl, 2-ethylhexyl, n-octyl, di-isobutyl, decyl, lauryl, oleyl or stearyl group.

6. A method as claimed in claim 7 or claim 2, wherein X and Y are independently hydrogen or chlorine atom, or a methyl or octyl group.

7. A method as claimed in claim 1 or 2, wherein $M_1$ and $M_2$ are independently hydrogen, sodium, potassium, magnesium, calcium, barium, zinc, chromium, cobalt, nickel or manganese.

8. A method as claimed in claim 1 or 2, wherein $M_1$ and $M_2$ are independently an ammonium, ethylammonium, trimethyl ammonium, pyridinium, N-ethyl pyridinium, benzyl trimethylammonium or cetylpyridinium ion.

9. A method as claimed in claim 1 or 2, wherein when $R_1$, $R_2$, $R_3$, $R_4$ are alkyl groups, said alkyl groups contain from 1 to 4 carbon atoms.

10. A method as claimed in claim 8, wherein the aqueous composition is added to a dye bath, whereafter said dye bath is used to perform said dyeing.

11. A method as claimed in claim 1 or 2, wherein the compound is a salt of the ethyl, benzyl or cyclohexyl monoester of maleic acid.

12. A method as claimed in claim 1 or 2, wherein the compound is sodium ethyl maleate,
sodium benzyl maleate, or
sodium cyclohexyl maleate, 13. A method as claimed in claim 1 or 2, wherein the compound is

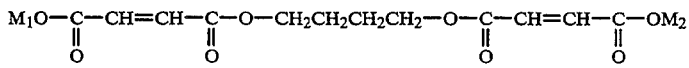

or

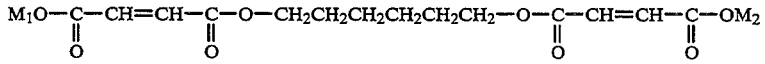

where $M_1$ and $M_2$ are sodium.

14. A method as claimed in claim 1, wherein said dyeing is a long-liquor dyeing.

15. A method as claimed in claim 1, wherein said material is contacted with said aqueous composition simultaneously with said dyeing.

16. A method as claimed in claim 1, wherein said material is contacted with said aqueous composition prior to said dyeing.

17. A textile material consisting wholly or partly of keratinous fibres produced by the method as described in claims 1 or claim 2.

* * * * *